US006640208B1

(12) United States Patent
Zhang et al.

(10) Patent No.: US 6,640,208 B1
(45) Date of Patent: Oct. 28, 2003

(54) VOICED/UNVOICED SPEECH CLASSIFIER

(75) Inventors: Yaxin Zhang, Hurstville (AU); Jianming Song, Kingsgrove (AU); Anton Madievski, Maroubra (AU)

(73) Assignee: Motorola, Inc., Schaumburg, IL (US)

( * ) Notice: Subject to any disclaimer, the term of this patent is extended or adjusted under 35 U.S.C. 154(b) by 459 days.

(21) Appl. No.: 09/659,318

(22) Filed: Sep. 12, 2000

(51) Int. Cl.[7] ..... G10L 11/06
(52) U.S. Cl. ..... 704/214; 704/217
(58) Field of Search ..... 704/205–221, 704/224

(56) References Cited

U.S. PATENT DOCUMENTS 5,742,734 A * 4/1998 DeJaco et al. ..... 704/226
5,809,453 A * 9/1998 Hunt ..... 704/214
5,809,455 A * 9/1998 Nishiguchi et al. ..... 704/214
5,911,128 A * 6/1999 DeJaco ..... 704/200.1
5,930,747 A * 7/1999 Iijima et al. ..... 704/207
6,480,823 B1 * 11/2002 Zhao et al. ..... 704/226

* cited by examiner

*Primary Examiner*—Richemond Dorvil
*Assistant Examiner*—Abul K. Azad
(74) *Attorney, Agent, or Firm*—Kenneth A. Haas

(57) ABSTRACT

A voiced/unvoiced speech classifier (30) includes a speech segmentor (34) which segments an input digitized speech waveform into frames of speech and a band-pass filter (36) which filters the frames of speech. A relative energy generator (38) generates a relative energy value for each filtered frame of speech and a decision parameter generator (52) including an autocorrelation calculator (54) and a pitch calculator (56) generates a decision parameter based on an autocorrelation function and a pitch frequency index for the filtered frames of speech. A normalized energy calculator (46) adjusts the threshold and then normalizes the relative energy. A comparator (60) provides a signal indicative of whether a frame of speech is voiced speech or unvoiced speech depending on a comparison of the decision parameter and the normalized relative energy value for each filtered frame of speech.

17 Claims, 3 Drawing Sheets

VOICED/UNVOICED SPEECH CLASSIFIER

FIELD OF THE INVENTION

This invention relates to a voiced/unvoiced speech classifier, which can be used in, for example, speech recognition systems and/or speech coding systems.

BACKGROUND OF THE INVENTION

A voiced sound is one generated by the vocal cords opening and closing at a constant rate giving off pulses of air. The distance between the peaks of the pulses is known as the pitch period. An example of a voiced sound is the "i" sound as found in the word "pill". An unvoiced sound is one generated by a single rush of air which results in turbulent air flow. Unvoiced sounds have no defined pitch. An example of an unvoiced sound is the "p" sound in the word "pill". A combination of voiced and unvoiced sounds can thus be found in the word "pill", as the "p" requires the single rush of air and the "ill" requires a series of air pulses.

Although essentially all languages use voiced and unvoiced sounds, in tonal languages, the tone occurs only in the voiced segments of the words.

Speech recognition techniques are well known for recognising words spoken in English or other non-tonal languages. These known speech recognition techniques basically perform transformations on segments (frames) of speech, each segment having a plurality of speech samples, into sets of parameters sometimes called "feature vectors". Each set of parameters is then passed through a set of models, which has been previously trained, to determine the probability that the set of parameters represents a particular known word or part-word, known as a phoneme, the most likely phoneme being output as the recognised speech. However, when these known techniques are applied to tonal languages, they generally fail to deal adequately with the tone-confusable words and phonemes that occur. Many Asian languages fall in this category of tonal languages. Unlike English, a tonal language is one in which tones have lexical meanings and have to be considered during recognition.

It is therefore important to be able to distinguish between the voiced and unvoiced speech segments to facilitate both speech recognition, especially of tonal languages, and speech coding, since the recognition and coding techniques can be substantially different for voiced and unvoiced speech segments and more efficient systems can be designed to deal with the two types in different ways.

BRIEF SUMMARY OF THE INVENTION

The present invention therefore seeks to provide a voiced/unvoiced speech classifier, especially one that can be used in speech recognition systems or in speech coding systems.

Accordingly, in a first aspect, the invention provides voiced/unvoiced speech classifier comprising an input terminal for receiving a digitized speech signal, a feature extractor having an input coupled to the input terminal and an output providing feature vectors of the input speech signal, a correlator having an input coupled to the output of the feature extractor and an output providing an indication of the degree of autocorrelation of the feature vectors of the input speech signal, and a decision maker having a first input coupled to the output of the correlator, a second input for receiving a threshold value and an output providing a signal indicative of whether a measure of the input speech signal at least partly based on the degree of autocorrelation of the feature vectors of the input speech signal is above or below the threshold value.

In a preferred embodiment, the voiced/unvoiced speech classifier further comprises a Signal to Noise Ratio (SNR) calculator having an input coupled to the input terminal and an output providing a SNR signal, and a threshold value adjuster having an input coupled to the output of the SNR calculator and an output coupled to the second input of the comparator to provide thereto the threshold value adjusted according to the SNR signal.

Preferably, the measure of the input speech signal is based at least partly on the degree of autocorrelation of the input speech signal and on the energy of the input speech signal.

The voiced/unvoiced speech classifier preferably further comprises a signal energy calculator having an input coupled to the input terminal and an output providing an indication of the energy of the input speech signal, and a combiner having a first input coupled to the output of the correlator, an output coupled to the first input of the comparator and a second input coupled to the output of the signal energy calculator providing the measure of the input speech signal.

The measure (M) of the input speech signal is preferably provided by:

$$M=\alpha_1 E+\alpha_2 A.$$

where $\alpha_1$ and $\alpha_2$ are predetermined constants, E is the energy of the input speech signal and A is the degree of autocorrelation of the feature vectors of the input speech signal. $\alpha_1$ preferably has a value between 0.1 and 0.5, most preferably 0.3, and $\alpha_2$ preferably has a value between 0.5 and 0.9, most preferably 0.7.

According to a second aspect, the invention provides a voiced/unvoiced speech classifier comprising an input terminal for receiving a digitized speech signal, a speech segmentor having an input coupled to the input terminal for segmenting the input digitized speech waveform into frames of speech provided at an output of the speech segmentor, a band-pass filter having an input coupled to the output of the speech segmentor for filtering the frames of speech and an output for providing filtered frames of speech, a relative energy generator having an input coupled to the output of the band-pass filter for generating a relative energy value for each filtered frame of speech and an output, a decision parameter generator comprising an autocorrelation calculator having an input coupled to the output of the band-pass filter for generating a decision parameter at an output of the decision parameter generator based on an autocorrelation function for the filtered frames of speech, and a comparator having a first input coupled to the output of the relative energy generator, a second input coupled to the output of the decision parameter generator and an output providing a signal indicative of whether a frame of speech is voiced speech or unvoiced speech depending on a comparison of the decision parameter and the relative energy value for each filtered frame of speech.

Preferably, the band-pass filter has a bandwidth covering a majority of pitch frequencies of a human voice.

In a preferred embodiment, the relative energy generator comprises a first energy calculator having an input coupled to the band-pass filter and an output for providing an energy value for each filtered frame of speech, a second energy calculator having an input coupled to the speech segmentor and an output for providing an energy value for each unfiltered frame of speech, and a relative energy value calculator having a first input coupled to the output of the first energy calculator, a second input coupled to the output of the second energy calculator, and an output for providing a relative energy value for each frame of speech based on the energy values for the filtered and unfiltered frame of speech.

The voiced/unvoiced speech classifier preferably further comprises a threshold generator having an input coupled to the output of the relative energy generator for providing an adjusted threshold at an output of the threshold generator. The threshold generator preferably comprises a threshold calculation unit having an input coupled to the output of the relative energy generator for calculating an initial threshold from the average relative energy value of a first section of input speech including a plurality of frames of speech. Preferably, the threshold generator further comprises a normalized relative energy calculator having a first input coupled to the output of the relative energy generator, a second input coupled to an output of the threshold calculation unit, and an output coupled to the comparator for providing a normalized relative energy value.

In one preferred embodiment, the decision parameter generator further comprises a pitch frequency estimator having an input coupled to the output of the band-pass filter and an output for providing an estimated pitch frequency index, and a decision parameter calculation unit having a first input coupled to an output of the autocorrelation calculator, a second input coupled to the input of the pitch frequency estimator, and an output for providing the decision parameter based on the autocorrelation function and the estimated pitch frequency index.

According to a third aspect, the invention provides a speech classifier comprising an input terminal for receiving input speech samples, an energy calculator having an input coupled to the input terminal for calculating the energy of a frame of speech samples to provide an energy value for each frame of speech samples at an output thereof, an autocorrelator having an input coupled to the output of the energy calculator for correlating the energy value of a frame of speech samples to provide correlation values indicating a periodicity of the speech samples at an output thereof, a parameter generator having a first input coupled to the output of the energy calculator, a second input coupled to the output of the autocorrelator, and an output for providing at least one parameter based on the energy value and the correlation values indicative of the periodicity and the energy of a frame of speech samples, and a comparator having an input coupled to the output of the parameter generator for comparing the parameter with at least one threshold value to provide an indication, at an output of the classifier, of whether each frame of speech samples is voiced speech or not Preferably, the speech classifier further comprises a threshold adjuster having an input coupled to the output of the energy calculator and an output for providing the at least one threshold value adjusted according to a measure of ambient noise level in the frame of speech samples.

BRIEF DESCRIPTION OF THE DRAWINGS

One embodiment of the invention will now be more fully described, by way of example, with reference to the drawings, of which.

DETAILED DESCRIPTION OF THE DRAWINGS

Figure 1:
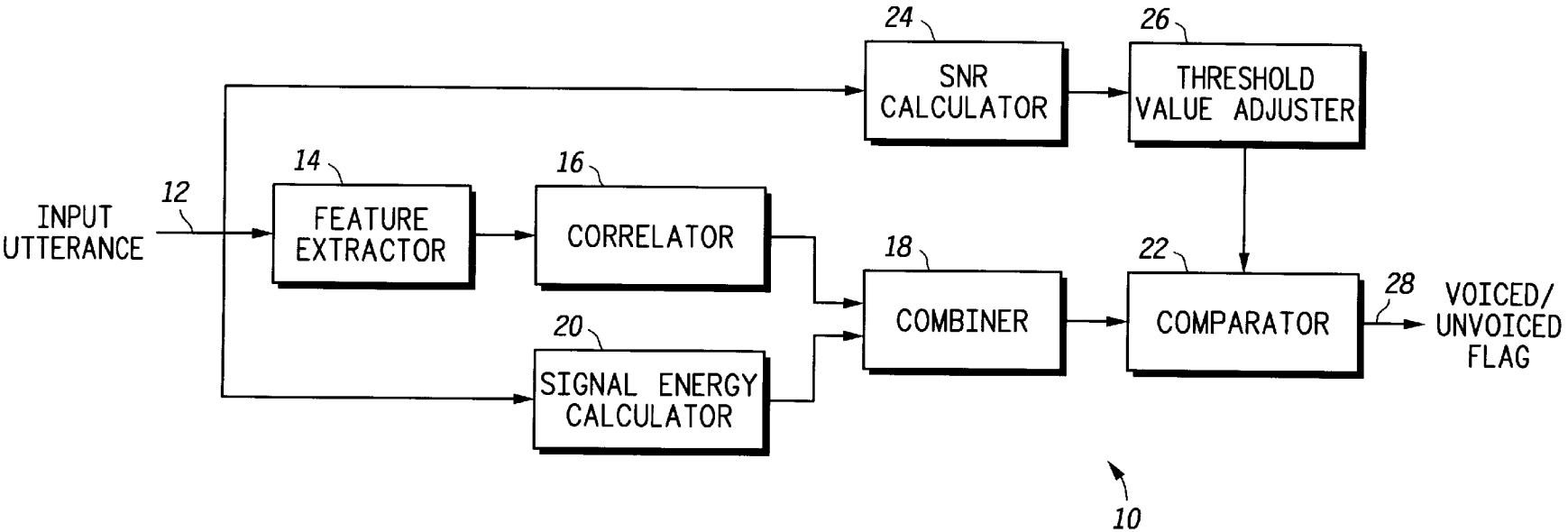
FIG. 1 shows a schematic block diagram of a first embodiment of a voiced/unvoiced speech classifier according to the present invention.

Thus, as shown schematically in FIG. 1, a first embodiment of a voiced/unvoiced speech classifier 10 includes an input terminal 12 for receiving a digitized input utterance. A feature extractor 14 receives the input speech utterance, divides it into frames of speech and extracts acoustic features from the input utterance using any desired method, as is well known in the field, to provide a feature vector for each of the frames. The feature vectors are then passed to a correlator 16 where they are correlated using an autocorrelation function to provide an autocorrelation value, which is passed to a combiner 18, where the autocorrelation value is combined with an energy value provided by a signal energy calculator 20, which receives the input utterance from input terminal 12 and determines the energy of the input utterance. The combiner thus produces a parameter, which is based on the energy of the utterance and its autocorrelation. This parameter is passed to a comparator 22, where it is compared with a threshold value to determine whether the input utterance is voiced speech or not.

A Signal-To-Noise Ratio (SNR) calculator 24 also receives the input utterance from input terminal 12 and determines the relative energy of the signal compared to the background, or noise signal. This relative energy value is passed to a threshold value adjuster 26, which adjusts the threshold value passed to the comparator 22 depending on the relative energy value from the SNR calculator 24.

The comparator 22 therefore compares the parameter based on the energy of the utterance and its autocorrelation, with a threshold value which is adjusted based on the relative energy of the signal compared to the background noise. If the parameter is found to be greater than the threshold level, then it is considered that the input utterance is voiced speech and a suitable indication is provided at the output 28 of the comparator 22, otherwise, an indication that the input utterance is not voiced speech is provided.

Figure 2:
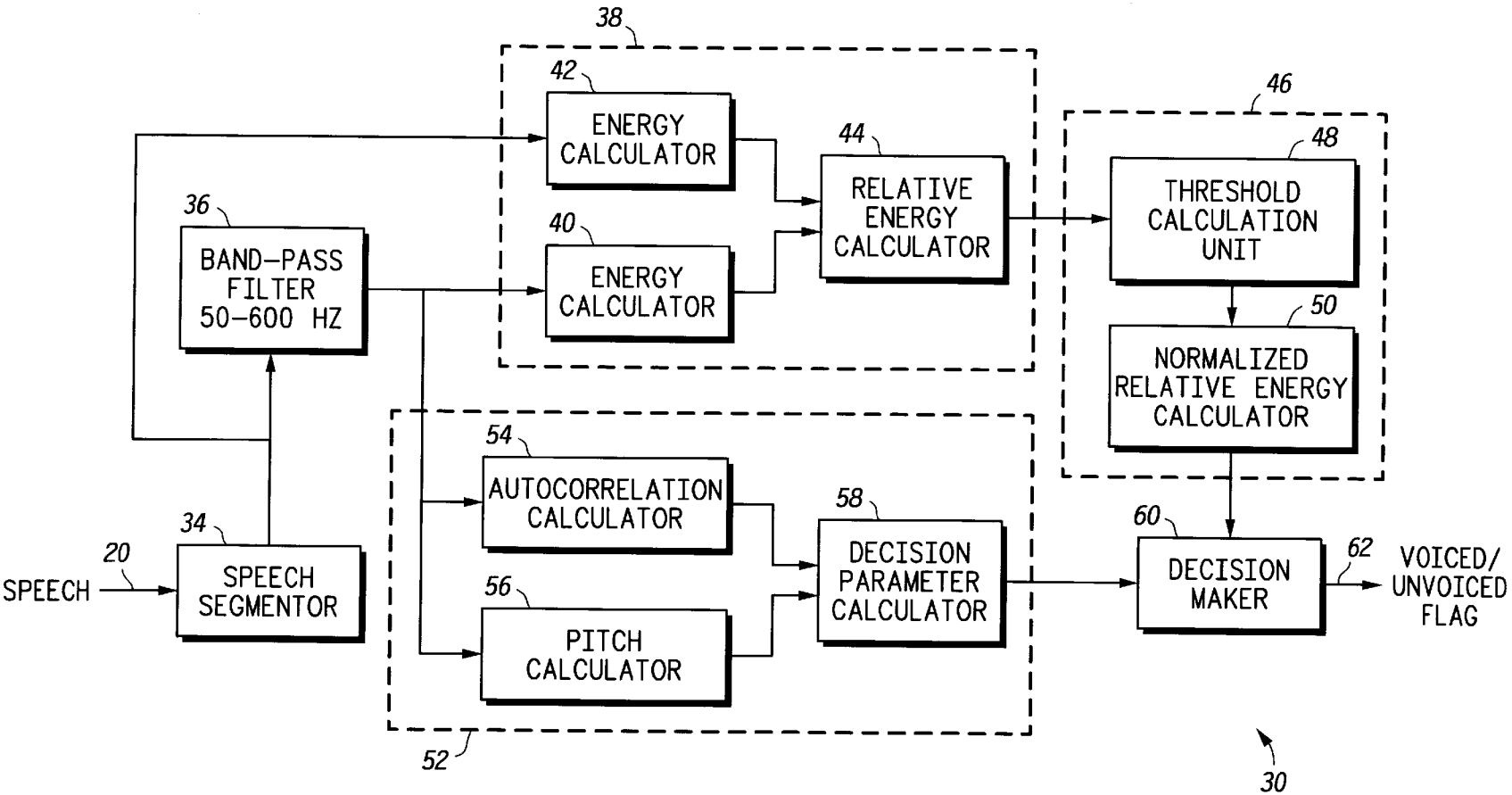
FIG. 2 shows a schematic block diagram of a second embodiment of a voiced/unvoiced speech classifier according to the present invention.

FIG. 2 shows a second embodiment of a voiced/unvoiced speech classifier 30. The voiced/unvoiced classifier 30 receives input digitized speech at an input terminal 32 and passes the speech signal to a speech segmentor 34, which segments the input digitized speech waveform into frames, preferably of 10 to 20 milliseconds duration for each frame. In this embodiment, a frame length of 16 milliseconds is used. The frames of speech from the speech segmentor 34 are provided to a band-pass filter 36, which can be implemented as any known type of IIR (Infinite duration Impulse Response) filter, preferable with a bandwidth of 50 Hz to 600 Hz, although the bandwidth may be shrunk or expanded on one or both sides, as desired according to the application.

A relative energy generator 38 consists of two identical energy calculators 40 and 42. A first energy calculator 40 takes one frame A of filtered speech from the band-pass filter 36 and calculates its frame energy $E_A$ as:

$$E_A = \sum_{i=1}^{N} x_i^2$$

where N is the number of digitized points x in the frame A of filtered speech, or frame length, and $x_i$ is the ith filtered speech point. The frame energy $E_A$ is provided at an output of the first energy calculator 40.

A second energy calculator 42 takes one frame B of unfiltered 25 speech from the speech segmentor 34 and calculates its frame energy $E_B$ as:

$$E_B = \sum_{i=1}^{N} y_i^2$$

where N is the number of digitized points y in the frame B of unfiltered speech, or frame length, and $y_i$ is the ith unfiltered speech point. The frame energy $E_B$ is provided at an output of the second energy calculator 42.

A relative energy calculator 44 has first and second inputs coupled to the outputs of the first and second energy calculators 40 and 42, respectively, to calculate the relative energy RE as:

$$\mathrm{RE} = \frac{E_B}{E_A}$$

The relative energy RE is provided at an output of the relative energy generator 38 and is passed to a threshold adjustment unit 46.

The threshold adjustment unit 46 includes a threshold calculation unit 48 and a normalized relative energy calculator 50 to provide a normalized energy value as the adjusted threshold value at the output of the threshold adjustment unit. The threshold calculation unit 48 is used to adjust a threshold value generated in the previous frame. An initial threshold value is calculated from the average energy of the first ten frames of the input signal. A normalized energy value is then calculated by the normalized relative energy calculator 50 from the current relative energy RE from the output of the relative energy generator 44 and the threshold value from the output of the threshold calculation unit 48, and sent to a decision maker 60.

Figure 3:
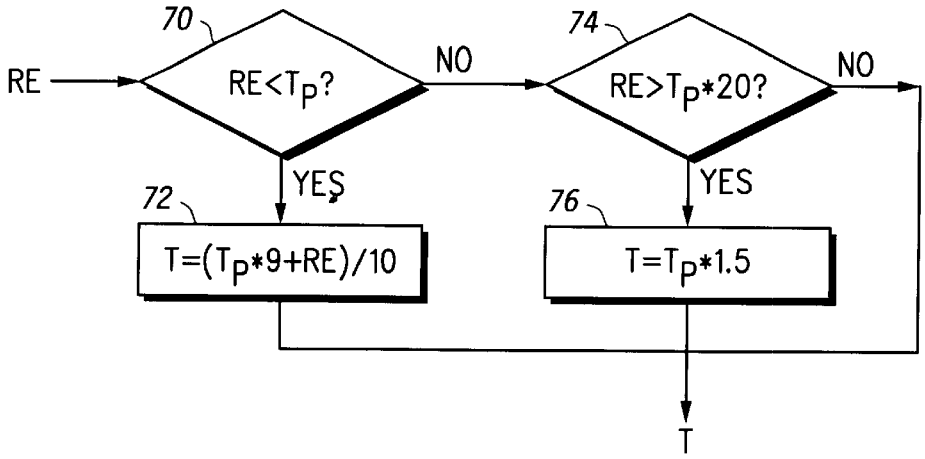
FIG. 3 shows a flow chart of a threshold adjustment procedure used in the voiced/unvoiced speech classifier of FIG. 2.

FIG. 3 shows a flowchart of the operation details of the adjustment process carried out by the threshold calculation unit 48. The relative energy RE of a current frame of speech is received from the output of the relative energy generator 44 and is compared, at step 70, to the threshold value $T_P$ generated in the previous frame. If the current relative energy RE is smaller than the previous threshold value $T_P$, the adjusted threshold value T is calculated, in step 72, as:

$$T = \frac{T_P \times 9 + \mathrm{RE}}{10}$$

and the adjusted threshold value T is provided at an output 78 of the threshold calculation unit 48.

If the current relative energy RE is not smaller than the previous threshold value $T_P$, then a determination is made, in step 74, whether the relative energy RE of the current frame of speech is greater than 20 times the previous threshold value $T_P$. If it is not, then the previous threshold value $T_P$ is provided at the output 78 as the adjusted threshold value T. If it is, then the adjusted threshold value T is calculated, in step 76, as:

$$T = T_P \times 1.5$$

and the adjusted threshold value T is provided at the output 78 of the threshold calculation unit 48.

As mentioned above, the initial threshold value $T_0$ is the average relative energy of a section at the beginning of the speech waveform. The section may include a plurality of frames of input digitized speech. In this embodiment, a section having the first 10 frames of speech is chosen for the initial threshold value calculation. Thus, in this implementation, the initial threshold value $T_0$ is calculated as:

$$T_0 = \frac{1}{10}\sum_{i=1}^{10} RE_i$$

where $RE_i$ is the relative energy of ith frame.

The normalized relative energy calculator 50 has a first input coupled to the output of the relative energy generator 44 and a second input coupled to the output of the threshold calculation unit 48 and calculates the normalized relative energy value $NE_i$ from the relative energy value $RE_i$ and the adjusted threshold value $T_i$ of the ith frame, respectively, as:

$$NE_i = \frac{RE_i}{T_i}$$

to provide the output of the threshold adjustment unit 46.

A decision parameter generator 52 consists of an autocorrelation calculator 54 and a pitch calculator 56. The autocorrelation calculator 54 is coupled to the band-pass filter 36 to receive the filtered speech frames and to calculate the autocorrelation function of each frame. The pitch calculator 56 also receives the filtered speech frames from the band-pass filter 36 to estimate a pitch frequency index. A decision parameter calculator 58 has a pair of inputs to receive the autocorrelation function and the pitch frequency index and calculates a parameter which is passed to the decision maker 60 where the final determination takes place, as will be described in more detail below.

The autocorrelation calculator 54 calculates the autocorrelation function $R^i$ (k) as:

$$R^i(k) = \sum_{j=1}^{N+1-k} x_j^i \times x_{j+k}^i$$

where i indicates the ith frame, N is the frame length, k is an index of autocorrelation and in the range of $1 \leqq k \leqq N$, x is a speech sample point, and $x_j$ indicates the jth sample point. Although, the above equation is provided as an example in this embodiment to calculate the autocorrelation function, any other variation of the equation can be used, as desired to obtain a desired performance.

The pitch calculator 56 takes a frame of filtered speech from band-pass filter 36 and estimates its pitch frequency index. Pitch calculator 56 can be implemented as any known type of pitch frequency estimator, as desired.

The decision parameter calculator 58 receives the autocorrelation function R (k) from the autocorrelation calculator 54 and the pitch frequency index from the pitch calculator 56 and calculates the decision parameter. Firstly, the peak point p of the autocorrelation function is normalized as follows:

$$p = \frac{R(k)}{R(0)}$$

or each pitch index k. Then an averaged autocorrelation function r is determined, as follows:

$$r=\sqrt{\frac{1}{121}\sum_{i=20}^{120}\left(\frac{R(i)}{R(0)}\right)^2}$$

where the particular values have been chosen based on a frame length of N=128. The numbers in this equation may be changed accordingly if the frame length changes. Finally, the decision parameter DP is determined as:

$$DP=p+3\times r$$

The decision maker 60 compares the decision parameter DP generated by the decision parameter generator 52 and the adjusted threshold value NE generated by the threshold adjustment unit 46 with three predefined constants, and makes a final decision as to whether the current frame of speech belongs to voiced speech or unvoiced speech.

Figure 4:
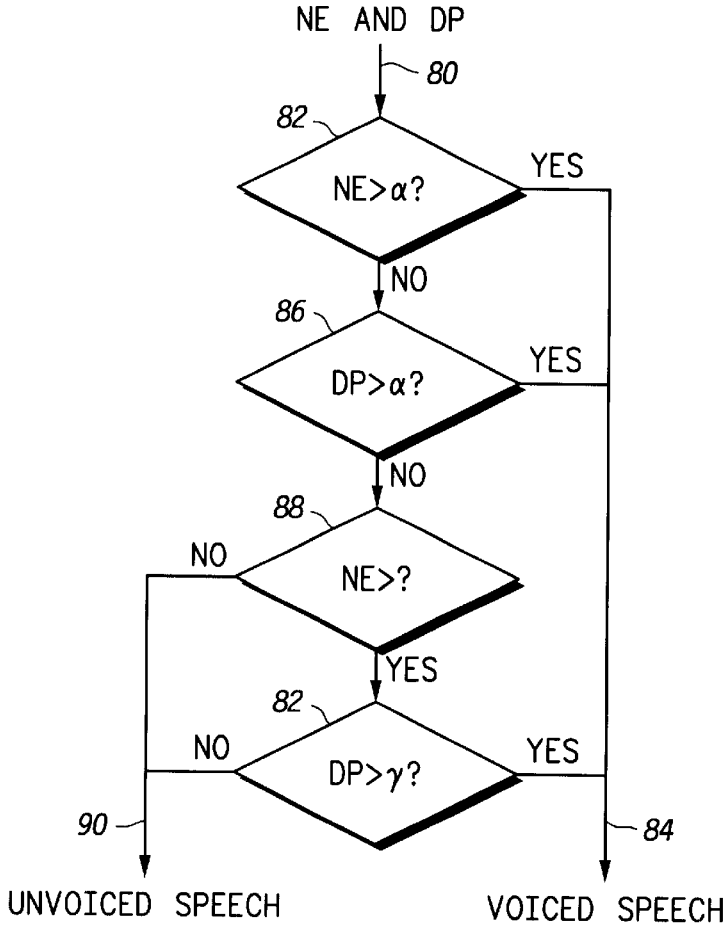
FIG. 4 shows a flow chart of a decision making process used in the voiced/unvoiced speech classifier of FIG. 2.

The decision-making logic is shown in FIG. 4 and follows the flowchart shown there, starting from the initial input step 80 at which the decision parameter DP and the adjusted threshold value NE are received. Firstly, in step 82, it is determined whether the normalized relative energy NE is greater than a first constant a. If it is, then it is considered that the input frame of speech is voiced speech, and the decision maker outputs an indication to that effect at step 84. Otherwise, if the normalized relative energy NE is not greater than the first constant $\alpha$, then the next step 86 is to determine whether the decision parameter DP is greater than the first constant $\alpha$. If it is, then it is considered that the input frame of speech is voiced speech, and the decision maker outputs an indication to that effect at step 84.

If the decision parameter DP is not greater than the first constant $\alpha$, then the process goes on to the next step 88, where it is determined whether the normalized relative energy NE is greater than a second constant P. If it is determined that the relative energy NE is smaller than or equal to the second constant $\beta$, then the input frame of speech is considered to be unvoiced speech, and the decision maker outputs an indication to that effect at step 90. If it is determined that the relative energy NE is greater than the second constant $\beta$, then the process goes on to the next step 92, where it is determined whether the decision parameter DP is greater than a third constant $\gamma$. If it is determined that the decision parameter DP is smaller than or equal to the third constant $\gamma$, then the input frame of speech is considered to be unvoiced speech, and the decision maker outputs an indication to that effect at step 90. If it is determined that the decision parameter DP is greater than the third constant $\gamma$, then the input frame of speech is considered to be voiced speech and the decision maker outputs an indication to that effect at step 84. The constants $\alpha$, $\beta$, and $\gamma$ have predefined values, which may be, for example, $\alpha$=7.0, $\beta$=3.0, $\gamma$=0.6.

It will be appreciated that although only one particular embodiment of the invention has been described in detail, various modifications and improvements can be made by a person skilled in the art without departing from the scope of the present invention.

What is claimed is:

1. A voiced/unvoiced speech classifier comprising:

an input terminal for receiving a digitized speech signal;

a feature extractor having an input coupled to the input terminal and an output providing feature vectors of the input speech signal;

a correlator having an input coupled to the output of the feature extractor and an output providing an autocorrelation value of the feature vectors of the input speech signal;

a decision maker having a first input coupled to the output of a combiner, a second input for receiving a threshold value and an output providing a signal indicative of whether a measure of the input speech signal partly based on the autocorrelation value of the feature vectors of the input speech signal is above or below the threshold value;

a Signal to Noise Ratio (SNR) calculator having an input coupled to the input terminal and an output providing a SNR signal;

a threshold value adjuster having an input coupled to the output of the SNR calculator and an output coupled to the second input of the comparator to provide thereto the threshold value adjusted according to the SNR signal;

a signal energy calculator having an input coupled to the input terminal and an output providing an indication of the energy of the input speech signal; and a combiner having a first Input coupled to the output of the correlator, an output coupled to the first input of the comparator and a second input coupled to the output of the signal energy calculator providing the measure of the input speech signal.

2. A voiced/unvoiced speech classifier according to claim 1, wherein the measure of the input speech signal is based at least on the autocorrelation value of the input speech signal and on the energy of the input speech signal.

3. A system for speech recognition incorporating a voiced/unvoiced speech classifier according to claim 1.

4. A system for speech coding incorporating a voiced/unvoiced speech classifier according to claim 1.

5. A voiced/unvoiced speech classifier comprising:

an input terminal for receiving a digitized speech signal;

a feature extractor having an input coupled lo the input terminal and an output providing feature vectors of the input speech signal;

a correlator having an input coupled to the output of the feature extractor and an output providing autocorrelation value of the feature vectors of the input speech signal; and a decision maker having a first input coupled to the output of a combiner, a second input for receiving a threshold value and an output providing a signal indicative of whether a measure of the input speech signal partly based on the autocorrelation value of the feature vectors of the input speech signal is above or below the threshold value, wherein the measure (M) of the input speech signal is provided by:

$$M=\alpha_1 E+\alpha_2 A.$$

where $\alpha_1$ and $\alpha_2$ are predetermined constants, E is the energy of the input speech signal and A is the autocorrelation value of the feature vectors of the input speech signal.

6. A voiced/unvoiced speech classifier according to claim 5, wherein $\alpha_1$ has a value between 0.1 and 0.5.

7. A voiced/unvoiced speech classifier according to claim 6, wherein $\alpha_1$ has a value of 0.3.

8. A voiced/unvoiced speech classifier according to claim 5, wherein $\alpha_2$ has a value between 0.5 and 0.9.

9. A voiced/unvoiced speech classifier according to claim 8, wherein $\alpha_2$ has a value of 0.7.

10. A system for speech recognition incorporating a voiced/unvoiced speech classifier according to claim 5.

11. A system for speech coding incorporating a voiced/unvoiced speech classifier according to claim 5.

12. A voiced/unvoiced speech classifier according to claim 6, wherein $\alpha_1$ has a value of 0.3.

13. A voiced/unvoiced speech classifier according to claim 5, wherein $\alpha_1$ has a value between 0.5 and 0.9.

14. A voiced/unvoiced speech classifier according to claim 8, wherein $\alpha_2$ has a value of 0.7.

15. A voiced/unvoiced speech classifier comprising:

an input terminal for receiving a digitized speech signal;

a feature extractor having an input coupled to the input terminal and an output providing feature vectors of the input speech signal;

a correlator having an input coupled to the output of the feature extractor and an output providing an autocorrelation value of the feature vectors of the input speech signal;

a decision maker having a first input coupled to the output a combiner, a second input for receiving a threshold value and an output providing a signal indicative of whether a measure of the input speech signal partly based on the autocorrelation value of the feature vectors of the input speech signal is above or below the threshold value;

a signal energy calculator having an input coupled to the input terminal and an output providing an indication of the energy of the input speech signal; and a combiner having a first input coupled to the output of the correlator, an output coupled to the first input of the comparator and a second input coupled to the output of the signal energy calculator providing the measure of the input speech signal, wherein the measure (M) of the input speech signal is provided by:

$$M=\alpha_1 E+\alpha_2 A$$

where $\alpha_1$ and $\alpha_2$ are predetermined constants, E is the energy of the input speech signal and A is the autocorrelation value of the feature vectors of the input speech signal.

16. A voiced/unvoiced speech classifier according to claim 15, further comprising:

a Signal to Noise Ratio (SNR) calculator having an input coupled to the input terminal and an output providing a SNR signal; and a threshold value adjuster having an input coupled to the output of the SNR calculator and an output coupled to the second input of the comparator to provide thereto the threshold value adjusted according to the SNR signal.

17. A voiced/unvoiced speech classifier according to claim 16, wherein $\alpha_1$ has a value between 0.1 and 0.5.

* * * * *